US006554220B2

(12) United States Patent
Gambini

(10) Patent No.: US 6,554,220 B2
(45) Date of Patent: Apr. 29, 2003

(54) DEVICE FOR JOINING THE TRAILING EDGE OF A REEL OF PAPER ABOUT TO FINISH TO THE LEADING EDGE OF A NEW REEL

(76) Inventor: Giovanni Gambini, Via A. Omodeo 7, I -56124 Pisa (IT)

( * ) Notice: Subject to any disclaimer, the term of this patent is extended or adjusted under 35 U.S.C. 154(b) by 0 days.

(21) Appl. No.: 09/897,676

(22) Filed: Jul. 2, 2001

(65) Prior Publication Data

US 2002/0003187 A1 Jan. 10, 2002

(30) Foreign Application Priority Data

Jul. 5, 2000 (IT) ..... MI00A1516

(51) Int. Cl.[7] ..... B65H 19/18
(52) U.S. Cl. ..... 242/555.3; 242/554.2
(58) Field of Search ..... 242/554.2, 555.3, 242/555.4, 555.5, 555.6, 555.7

(56) References Cited

U.S. PATENT DOCUMENTS 3,309,035 A * 3/1967 Degutis ..... 242/555.5
3,353,765 A * 11/1967 Huck ..... 242/555.5
4,165,842 A * 8/1979 Mengel ..... 242/554.2
4,673,142 A * 6/1987 Keene et al. ..... 242/555.3
4,821,973 A * 4/1989 Tafel et al. ..... 242/554.2
4,875,633 A * 10/1989 Mochizuki et al. ..... 242/554.2
5,740,982 A * 4/1998 Kaufmann ..... 242/554.2
5,779,184 A * 7/1998 Kaufmann et al. ..... 242/554.2

* cited by examiner

*Primary Examiner*—John M. Jillions
(74) *Attorney, Agent, or Firm*—Hedman & Costigan, P.C.

(57) ABSTRACT

A device for joining the trailing edge of a reel of paper about to finish to the leading edge of a new reel comprising, on a supporting structure (11), a support (12) for the reel as it unwinds (13), a device (15) for transferring the reel (13) to a unit for tensioning the trailing edge (17) of the reel (13') about to finish, a cutting unit (32) of the trailing edge (17), at least one roller (43) that presses the trailing edge (17) on the new reel (13) once it has been positioned on the support (12) and provided with a double-sided tape (48) positioned crosswise on a lateral surface of the same in order to retain its leading edge (49).

7 Claims, 1 Drawing Sheet

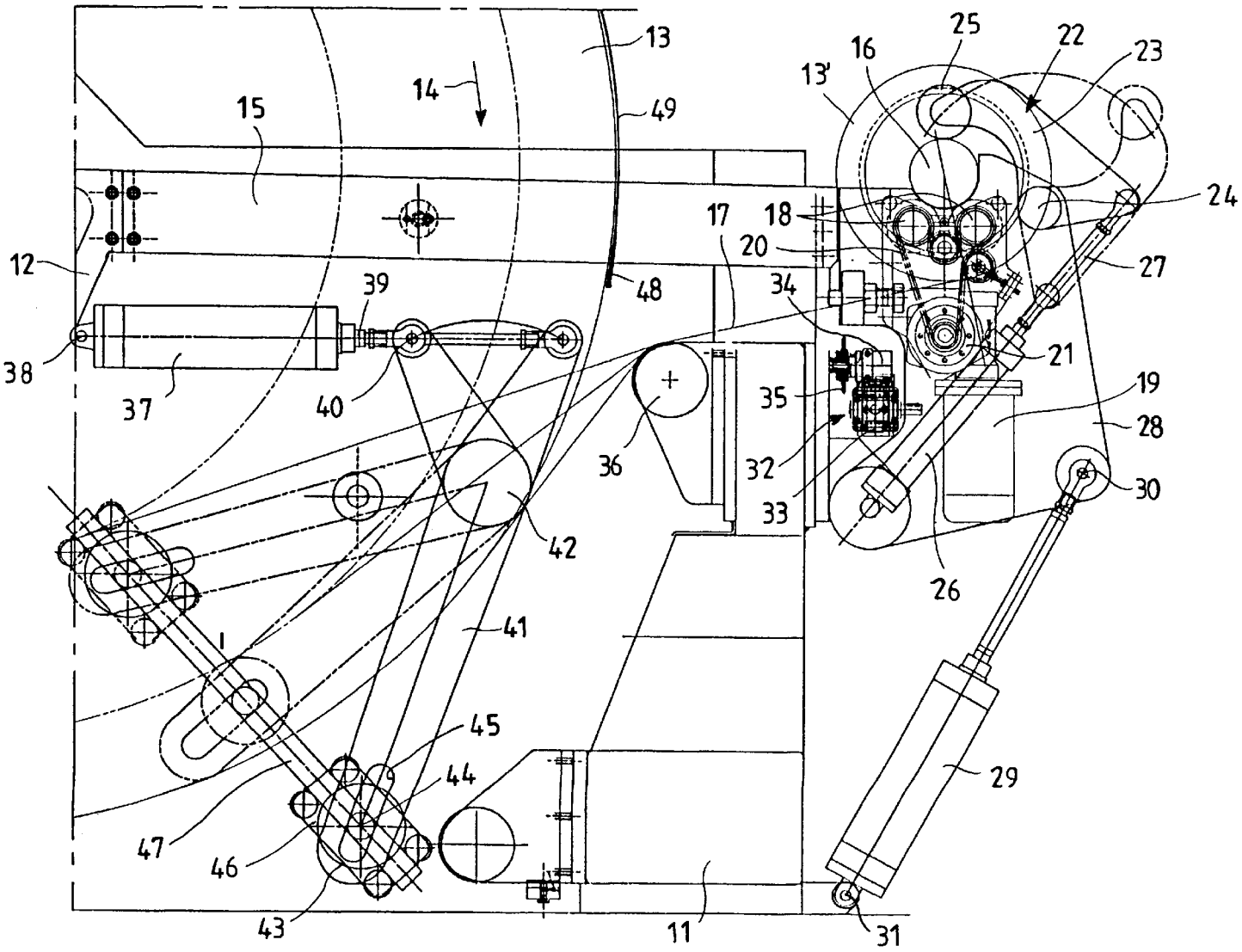
24
23
27
19
28
30
22
21
29
25
26
16
31
13'
18
20
34
35
32
33
17
11
13
49
48
36
42
41
45
44
14
39
40
43
15
46
47
37
12
38

DEVICE FOR JOINING THE TRAILING EDGE OF A REEL OF PAPER ABOUT TO FINISH TO THE LEADING EDGE OF A NEW REEL

This invention relates to a device for joining the, trailing edge of a reel of paper about to finish to the leading edge of a new reel.

In the field of preparation of toilet rolls, paper for domestic use and similar, the paper for forming a single roll, or "log", is currently unwound by a reel. This reel is positioned on a supporting and unwinding unit and when each reel has finished and has completely unwound, it must be replaced by a new reel full of paper.

This replacement currently entails manual operations involving cutting, connection of the trailing edge of the reel of paper about to finish to the leading edge of the new reel by means of adhesive tape and subsequent resumption of the unwinding operation.

The above operations require considerable time and, above all, the operator responsible for the joining operation must possess good manual skills in order to perform said function.

The shape of the reel, not always cylindrical, can cause further alignment problems between the edge of the paper about to finish and the edge of the paper still to be unwound.

Correct positioning of the adhesive tape can also be problematic if not performed with the necessary skill, likewise cutting of the trailing edge of the finished reel of paper must be performed correctly.

In particular the latter operation, if not performed properly, involves unnecessary waste of paper with additional non-recoverable costs and unnecessary waste of good quality material.

The object of this invention is therefore to identify an optimal technical solution to the problem illustrated and highlighted above.

A further object is to produce a device for joining the trailing edge of a reel of paper about to finish to the leading edge of a new reel that ensures rapid replacement of the reel.

Another object is to produce a device for performing the above task which is particularly simple to operate and does not involve unnecessary waste of material.

These objects according to the present invention are achieved by producing a device for joining the trailing edge of a reel of paper about to finish to the leading edge of a new reel.

The figure shows a device for joining the trailing edge of a reel of paper about to finish to the leading edge of a new reel, at least partially, on one side positioned at the end of a supporting structure 11.

The device comprises a support 12, partially shown, for a reel 13 which must be unwound and fed towards a work station, such as a log forming station. The support 12 sustains the reel 13, leaving it free to rotate so that the paper on it is unwound in the clockwise direction indicated by the arrow 14. Beside the support 12 a rolling surface 15 is provided consisting of rolling rods 16, only one of which is shown, acting as a transfer device. Said rods 16 are used to support the reel 13 and protrude at opposite ends of the central axis of the same. A unit for tensioning the trailing edge 17 of the paper unwinding from the reel 13' about to finish is positioned at the end of the rolling surface 15.

The tensioning unit consists of four supporting wheels 18 arranged two per side designed to house and move the ends of the rods 16 supporting the reel 13' about to finish. The wheels 18 are driven by a pair of gear motors 19 arranged one per side and connected to the wheels by a belt transmission 20 with insertion of a ball torque limiting device 21. This tensioning unit is completed by a pressure device 22 consisting of a pair of levers 23 with fulcrum at one end in 24 and bearing a pressure wheel 25 at the other end. The oscillation of the two levers 23 is obtained by means of a pneumatic cylinder 26 with stem 27 hinged to the levers 23 and with one end hinged to an oscillating plate 28.

A pair of oscillating plates 28 acts as a movable cradle for the entire system previously described, i.e. the tensioning unit, the pressure device 22 and the reel 13' about to finish. The downward movement of the pair of oscillating plates 28 is controlled by two cylinders 29 hinged to it in 30 and to the supporting structure in 31.

A cutting unit 32 is also provided, integral with the supporting structure 11, consisting of a pair of linear actuators 33 arranged one per side, each one bearing a trolley 34 sliding crosswise with respect to the trailing edge 17 of the paper being unwound. Each trolley 34 is provided with a respective rotating knife 35 driven by a motor (not shown).

The supporting structure 11 also bears a deviation roller 36 which directs the trailing edge 17 of the paper being unwound towards the support 12 where the reel 13 was positioned. On each side of the support 12 a cylinder 37 is positioned hinged in 38 to the support 12, the stem 39 of which is connected by means of a hinge 40 to an arm 41 in two parts hinged in the middle in 42 to the supporting structure 11. A rubber-coated roller 43 fitted on the arms 41 can be brought into contact with the outer lateral surface of the reel 13. More precisely the roller 43 is brought into contact by a trolley 46 which moves on a rod 47 attached to the supporting structure 11. The end pins 44 of the trolley 46 can be moved in slots 45 of the arms 41 permitting movement of the trolley, as the arms 41 rotate. The roller 43 which acts by pressure on the-outer surface of the reel 13 is shaped and features portions of larger diameter, or sectors, to prevent interference with unwinding belts acting on the reel 13. Said roller 43 has the function of pressing the- trailing edge 17 of the reel about to finish onto the surface of the new reel 13 thus permitting adhesion to a strip of double-sided tape 48 previously applied on the new reel 13. The presence of the pneumatic cylinders 37, thanks to the air contained in the cylinders, permits continuous adaptation of the roller 43 and the trailing edge 17 of the paper to the shape of the new reel 13.

Operation of the device for joining the trailing edge of a reel of paper about to finish to the leading edge of a new reel according to the present invention is as follows.

When the reel 13, initially positioned on the support 12, has almost finished, it is expelled by ejector devices (not shown) present on the unwinder unit and, moving over the rolling surface 15, it positions itself on the above-mentioned tensioning unit. The wheels 18 rotate the rods 16 thus tensioning the trailing edge 17 of the paper and eliminating the folds via the command actuated by the gear motor 19. Only then is a new reel 13 loaded on the support 12; the new reel is lowered from above by means of a loading system on the winder unit and not shown here.

As it moves down, the new reel 13 meets the trailing edge 17 previously tensioned and comes to rest on it. The ball torque limiting device 21 forming part of the tensioning unit rotates the reel about to finish 13' in order to keep the trailing edge 17 tensioned, avoiding breakage of the same.

Naturally, the new reel 13 is provided with a strip of double-sided tape 48 which retains its leading edge 49. The unwinding belts, not shown, are then tensioned on the reel 13 and only then do the cylinders 37, acting on the levers 41, move the roller 43 closer, acting as a pressure device. At this point the reel 13 is rotated briefly and the trailing edge 17 of the reel 13' about to finish is glued to the double-sided tape 48 of the new reel 13.

Activation of the cylinders 29 determines the descent of the plates 28 of the movable cradle so that the trailing edge 17 of the reel 13' about to finish is brought to the level of the cutting unit 32. This unit is then activated so that the rotating knives 35 cut the trailing edge 17, separating the reel about to finish so that the same can be expelled once the pressure device 22 has been disengaged from it.

At this point the reel 13 is ready and connected and can be newly rotated to unwind the paper and continue production.

In this way the advantages of a device for joining the trailing edge of a reel of paper about to finish to the leading edge of a new reel according to the present invention are obvious.

Positioning of the new reel and removal of the reel about to finish are particularly rapid. The down time involved in manual performance of said operations is consequently eliminated.

Furthermore, the device facilitates positioning of the double-sided tape and its attachment to the trailing edge of the reel about to finish which is immediately cut once the parts have been glued.

The presence of the tensioning unit of the trailing edge of the reel about to finish guarantees correct winding and connection between it and the new reel, regardless of the shape of the latter.

Waste of paper is also minimised as the reel about to finish can be removed when it is almost at the end.

The roller 43 is one single roller in the example but it can consist of several rollers which can even be independent.

As can be seen from the figure, a further advantage is that correct cutting and joining of the trailing edge on the new reel prepared with double-sided tape can be performed independently of the diameter of the reel 13. The figure shows via a dash-dot line three different diameters of the reel 13, like the respective three positions that can be assumed by the roller 43 which acts as a pressure device.

The reel diameter can be from 2500 mm to 1500 mm.

The device according to the invention is particularly useful for protecting dangerous areas, preventing accidental contacts between the operator and the dangerous areas.

The device according to the present invention therefore achieves the purposes previously illustrated.

What is claimed is:

1. A device for joining the trailing edge of a reel of paper about to finish to the leading edge of a new reel comprising, on a supporting structure (11), a support (12) for the reel as it unwinds (13), a device (15) for transferring the reel (13) to a unit for tensioning the trailing edge (17) of the reel (13') about to finish, a cutting unit (32) of said trailing edge (17), at least one roller (43) that presses said trailing edge (17) on said new reel (13) once it has been positioned on said support (12) and the new reel provided with a double-sided tape (48) positioned crosswise on a lateral surface of the same in order to retain its leading edge (49) wherein said tensioning unit consists of four supporting wheels (18) arranged two per side designed to house and move the ends of the rods (16) supporting the reel about to finish (13'), said wheels (18) being driven by a pair of gearmotors (19) arranged one per side and connected by a belt transmission (20) with insertion of a ball torque limiting device (21).

2. Device according to claim 1, characterised in that a pressure device (22) is combined with said tensioning unit to securely house rods (16) on said wheels (18).

3. Device according to claim 2, characterised in that said pressure device (22) comprises a pair of levers (23) with fulcrum at one end (in 24), each one bearing at the other end a pressure wheel (25), said two levers (23) being oscillated each by a pneumatic cylinder (26) with hinged stem (27) and hinged end.

4. Device according to claim 2, characterised in that said tensioning unit and said pressure device (22) are arranged on a pair of oscillating plates (28) acting as a movable cradle with movement controlled by related actuators (29).

5. Device according to claim 2, characterised in that said cutting unit (32) is integral with said supporting structure (11) and consists of a pair of linear actuators (33) arranged one per side, each one bearing a trolley (34) sliding crosswise with respect to said trailing edge (17) of the paper being unwound, each trolley (34) being fitted with a respective rotating knife (35) activated by means of a motor.

6. Device according to claim 1, characterised in that each side of said support (12) is provided with a hinged cylinder (37) connected by means of hinge (40) to an arm (41) bearing said roller (43) said roller (43) is supported by a trolley (46) which moves on a rod (47) connected to said supporting structure (11), said trolley (46) having end pins (44) which can be moved in slots (45) of said arms (41) permitting movement of the trolley as said arms (41) rotate.

7. Device according to claim 6, characterised in that said arm (41) is in two parts and hinged in the middle (in 42) to said supporting structure (11) said roller (43) is supported by a trolley (46) which moves on a rod (47) connected to said supporting structure (11), said trolley (46) having end pins (44) which can be moved in slots (45) of said arms (41) permitting movement of the trolley as said arms (41) rotate.

* * * * *